US009042756B2

(12) United States Patent
Sakurada

(10) Patent No.: US 9,042,756 B2
(45) Date of Patent: May 26, 2015

(54) IMAGE FORMING APPARATUS

(71) Applicant: Konica Minolta, Inc., Chiyoda-ku, Tokyo (JP)

(72) Inventor: Takumi Sakurada, Hachioji (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/087,659

(22) Filed: Nov. 22, 2013

(65) Prior Publication Data

US 2014/0153944 A1 Jun. 5, 2014

(30) Foreign Application Priority Data

Dec. 4, 2012 (JP) ..... 2012-265637

(51) Int. Cl.
*G03G 15/10* (2006.01)
*G03G 15/08* (2006.01)

(52) U.S. Cl.
CPC ..... *G03G 15/0808* (2013.01)

(58) Field of Classification Search
CPC ..... G03G 15/0822; G03G 15/0844; G03G 14/0887; G03G 15/0889; G03G 15/0891; G03G 2215/0648
See application file for complete search history.

(56) References Cited

U.S. PATENT DOCUMENTS

2005/0265738 A1* 12/2005 Ogata ..... 399/27
2007/0048027 A1* 3/2007 Park ..... 399/258
2009/0232524 A1* 9/2009 Takahashi et al. ..... 399/27
2009/0245832 A1* 10/2009 Aoki et al. ..... 399/53
2011/0255888 A1* 10/2011 Itoyama et al. ..... 399/30
2014/0010561 A1* 1/2014 Kubo et al. ..... 399/53

FOREIGN PATENT DOCUMENTS

JP 2011-209464 A 10/2011

* cited by examiner

*Primary Examiner* — Clayton E Laballe
*Assistant Examiner* — Ruifeng Pu
(74) *Attorney, Agent, or Firm* — Cantor Colburn LLP

(57) ABSTRACT

In an image forming apparatus that is provided with a developing unit to develop an electrostatic latent image formed on an image carrier as a toner image, the developing unit is provided with a developer reservoir that is disposed between a supplying roller to feed developer agitated by an agitating member into the developer reservoir and a developing roller to cause the developer in the developer reservoir to adhere onto the latent image on the image carrier so as to be developed as the toner image. A control section controls driving of the supplying roller, independently from driving of the agitating member.

3 Claims, 4 Drawing Sheets

IMAGE FORMING APPARATUS

CROSS REFERENCES TO RELATED APPLICATIONS

The present invention contains subject matter related to Japanese Patent Application JP 2012-265637, filed in the Japanese Patent Office on Dec. 4, 2012, the entire contents of which being incorporated herein by reference.

BACKGROUND OF THE INVENTION

1. Field of the Invention

The present invention relates to an image forming apparatus that is provided with a developing unit to develop, as a toner image, an electrostatic latent image formed on an image carrier, such as a photoreceptor.

2. Description of the Related Art

Recently, there have been prevailing various kinds of image forming apparatuses, such as a copier, a printer, a facsimile, and a multi-functional peripheral, that form an image on a transfer material, such as a sheet. Each of such image forming apparatuses exposes a charged photoreceptor based on image data so as to form an electrostatic latent image of the image data thereon; causes developer (toner) to adhere onto the electrostatic latent image on the photoreceptor so as to develop the electrostatic latent image as a toner image; and transfers the toner image on the photoreceptor onto a transfer material, such as a sheet, so as to form an image on the transfer material.

In such image forming apparatuses, a developing unit, having a role of developing an electrostatic latent image formed on a photoreceptor as a toner image, with developer (toner), agitates the developer so as to be charged by means of friction, and supplies the charged developer to a developing roller so as to be born thereon. The developing roller causes, by being rotated, the developer born thereon to adhere onto an electrostatic latent image portion of a photoreceptor.

In a case where a printing ratio of an image to be formed on a transfer material according to image data (ratio of the area of an image to be formed on a transfer material according to image data to the area of the transfer material on which the image is formed) is relatively low, the amount of developer to be consumed for the image formation is relatively low. For this reason, while a relatively large amount of sufficiently-charged developer exists in the developing unit, the amount of developer to be newly replenished into the developing unit is relatively small, so that the sufficiently-charged developer is supplied to the developing roller.

However, when the printing ratio rises, the consumption amount of developer increases, and it becomes necessary to replenish a relatively large amount of new developer into the developing unit. If a state that the printing ratio is relatively high continues, it occurs that newly replenished developer is supplied onto the developing roller in a state of having been insufficiently agitated, i.e., insufficiently charged. Consequently, a fogging phenomenon that developer adheres onto portions other than the electrostatic latent image on the photoreceptor occurs.

Conventionally, as a technique to suppress the fogging phenomenon, the technique to increase the rotation speed of an agitating member that agitates developer in a developing unit has been proposed (for instance, refer to Japanese Patent Laid-Open Publication No. 2011-209464).

However, according to the technique set forth in Japanese Patent Laid-Open Publication No. 2011-209464, since the action of the agitating member for agitating the developer so as to be charged and the action thereof for supplying the charged developer onto a developing roller are not independent from each other, when a large amount of new developer is replenished to the developing unit, such a case occurs that newly replenished developer is supplied onto the developing roller without having been sufficiently agitated by the agitating member. For this reason, when a large amount of new developer is replenished to the developing unit, it occurs that insufficiently charged developer is supplied onto the developing roller, and as a result, the fogging phenomenon cannot be suppressed.

SUMMARY OF THE INVENTION

In view of the above-mentioned point, an object of the present invention is to suppress occurrence of the fogging phenomenon in an image forming apparatus by preventing insufficiently charged developer from being supplied onto a developing roller of a developing unit.

To achieve the object of the present invention, an image forming apparatus in accordance with an embodiment of the present invention includes a developing unit configured to develop a latent image formed on a photoreceptor according to image data, with developer, the developing unit including: an agitating member configured to agitate the developer replenished into the developing unit, so as to be electrically charged; a supplying roller configured to bear thereon the developer charged by being agitated by the agitating member and to be driven to rotate to feed the charged developer borne thereon; a developer reservoir configured to store therein the charged developer fed by the supplying roller; and a developing roller configured to bear thereon the charged developer stored in the developer reservoir and to cause the charged developer born thereon to adhere onto the latent image on the photoreceptor to develop the latent image with the developer. The developer reservoir is disposed between the supplying roller and the developing roller, and the supplying roller feeds the developer charged by being agitated by the agitating member into the developer reservoir. The image forming apparatus further includes a control section configured to control driving of the supplying roller independently from driving of the agitating member.

DESCRIPTION OF THE PREFERRED EMBODIMENTS

Figure 1:
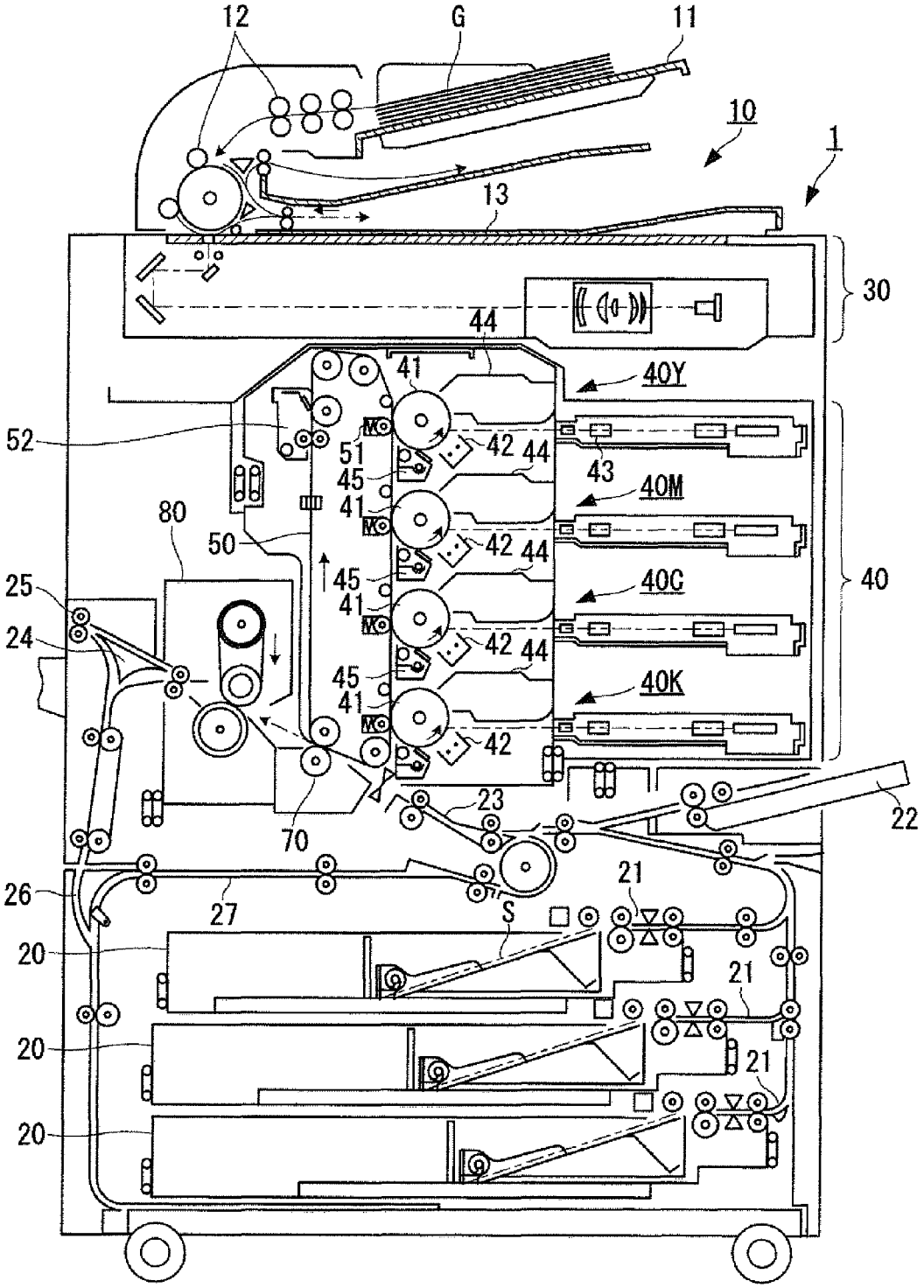
FIG. 1 is a diagram showing each constitution of an image forming section, an intermediate transfer belt, a secondary transfer section, a fixing section, etc. of an image forming apparatus in accordance with an embodiment of the present invention.

Referring to the drawings, an embodiment of the present invention will be detailed in the following.

FIG. 1 shows each constitution of an image forming section, an intermediate transfer belt, a secondary transfer section, a fixing section, etc. of an image forming apparatus in accordance with an embodiment of the present invention. An image forming apparatus 1 employs an electro-photographic method to form an image on a sheet, and is a tandem type color-image forming apparatus in which four color toners of Yellow (Y), Magenta (M), Cyan (C) and Black (Bk) are superimposed to form a color image. The image forming apparatus 1 has an original-document feeding unit 10, sheet accommodating units 20, an image reading unit 30, an image forming section 40, an intermediate transfer belt 50, a secondary transfer section 70, and a fixing unit 80.

The original-document feeding unit 10 has an original-document feeding platen 11 onto which original-documents G are to be set, and a plurality of rollers 12. The original-documents G set on the original-document feeding platen 11 of the original-document feeding unit 10 are sequentially fed one by one to a reading position of the image reading unit 30 by the plurality of rollers 12. The image reading unit 30 reads an image of each original-document G fed by the original-document feeding unit 10 to the reading position or placed on an original-document platen 13, and generates image data thereof.

The sheet accommodating units 20 are disposed in the lower portion of the apparatus main body, corresponding to various sizes of sheets S. The sheets S accommodated in each sheet accommodation unit 20 are fed one by one to a feeding section 23 by a corresponding sheet feeding section 21, and further fed to the secondary transfer section 70, serving as a transfer position, by the feeding section 23. Further, a manual insertion unit 22 is disposed at a position in the vicinity of the uppermost sheet accommodating unit 20. From the manual insertion unit 22, anyone of a sheet having a size other than those of the sheets S accommodated in the sheet accommodating units 20, a tag sheet having a tag, a special sheet such as an OHP sheet, etc., is fed to the transfer position through the feeding section 23.

The image forming section 40 and the intermediate transfer belt 50 are arranged between the image reading unit 30 and the sheet accommodating units 20. The image forming section 40 includes four image forming units 40Y, 40M, 40C, 40K, which form toner images of respective colors: Yellow (Y), Magenta (M), Cyan (C), and Black (Bk).

The first image forming unit 40Y forms the toner image of Yellow, while the second image forming unit 40M forms the toner image of Magenta. Further, the third image forming unit 40C forms the toner image of Cyan, while the fourth image forming unit 40K forms the toner image of Black. Since the four image forming units 40Y, 40M, 40C, 40K have the same constitution, hereinafter, only the first image forming unit 40Y will be described.

The first image forming unit 40Y is provided with a drum-shaped photoreceptor 41, and a charging unit 42, an exposing unit 43, a developing unit 44, and a cleaning unit 45 are arranged around the photoreceptor 41. The photoreceptor 41 is rotated counterclockwise by a driving motor (not shown). The charging unit 42 gives an electric charge to the photoreceptor 41 so as to uniformly charge the surface of the photoreceptor 41. The exposing unit 43 performs exposure scanning on the surface of the photoreceptor 41, based on image data of an image of the original-document G generated by the image reading unit 30, for example, and thereby an electrostatic latent image is formed on the photoreceptor 41.

The developing unit 44 causes yellow toner to adhere onto the electrostatic latent image formed on the photoreceptor 41. As a result, a yellow toner image is formed on the surface of the photoreceptor 41. Note that the developing unit 44 of the second image forming unit 40M causes magenta toner to adhere onto the electrostatic latent image formed on the photoreceptor 41, the developing unit 44 of the third image forming unit 40C causes cyan toner to adhere onto the electrostatic latent image formed on the photoreceptor 41, and the developing unit 44 of the fourth image forming unit 40K causes black toner to adhere onto the electrostatic latent formed on the photoreceptor 41. Although the inner constitution of the developing unit 44 is omitted in the diagram shown in FIG. 1, the constitution of the developing unit 44 will be detailed later on, using FIG. 2.

The toner adhering onto the electrostatic latent image formed on the photoreceptor 41 is transferred onto the intermediate transfer belt 50. After the toner adhering onto the electrostatic latent image on the photoconductor 41 has been transferred onto the intermediate transfer belt 50, the cleaning unit 45 removes the toner remaining on the surface of the photoreceptor 41.

The intermediate transfer belt 50 is formed in an endless shape, and is rotated in a clockwise direction, opposite to the rotating direction of the photoreceptor 41, by a driving motor (not shown). Primary transferring units 51 are disposed at respective positions facing the photoreceptors 41 of the image forming units 40Y, 40M, 40C, 40K across the intermediate transfer belt 50. Each primary transferring unit 51 applies an electric voltage, the polarity of which is opposite to that of the toner, to the intermediate transfer belt 50, and thereby the toner image formed on the photoreceptor 41 facing the primary transferring unit 51 is transferred onto the intermediate transfer belt 50.

By rotation of the intermediate transfer belt 50, toner images formed by the four image forming units 40Y, 40M, 40C, 40K are sequentially transferred onto the surface of the intermediate transfer belt 50. As a result, toner images of Yellow, Magenta, Cyan, and Black are superimposed one upon another on the intermediate transfer belt 50, and thereby a color image is formed thereon.

The secondary transfer section 70 is disposed at a position in the vicinity of the intermediate transfer belt 50, downstream of the feeding section 23. The secondary transfer section 70 is formed in a roller shape, and presses the sheet S, fed thereto by the feeding section 23, against the intermediate transfer belt 50. Thereby, the color image formed on the intermediate transfer belt 50 is transferred onto the sheet S fed to the secondary transfer section 70 by the feeding section 23. A cleaning unit 52 is disposed at a position in the vicinity of the intermediate transfer belt 50, downstream of the secondary transfer section 70 in the rotating direction of the intermediate transfer belt 50, and removes the toner remaining on the surface of the intermediate transfer belt 50 after the color image has been transferred onto the sheet S. Further, the fixing unit 80 is disposed on the sheet ejection side of the secondary transfer section 70. The fixing unit 80 applies heat and pressure onto the toner image transferred onto the sheet S so as to fix the toner image thereon.

A switching gate 24 is disposed at a position downstream of the fixing unit 80. The switching gate 24 switches the feeding path of the sheet S passed through the fixing unit 80. That is, in a case of a face-up (image-side upward faced) ejection mode in single-sided image formation, the switching gate 24 causes the sheet S to be fed straight ahead. As a result, the sheet S is ejected by a pair of ejection rollers 25, with the image-side faced upward. On the other hand, in a case of a face-down (image-side downward faced) ejection mode in single-sided image formation or in a case of double-sided image formation, the switching gate 24 guides the sheet S downward.

In the case of the face-down ejection mode, the sheet S is guided downward by the switching gate 24, and then, the sheet S is reversed upward by a sheet reversing and feeding unit 26. As a result, the sheet S is ejected by the pair of ejection rollers 25, with the image-side faced downward.

In the case of both-sided image formation, the sheet S is guided downward by the switching gate 24, and then the sheet S is reversed upward by the sheet reversing and feeding unit 26 to a sheet re-feeding path 27. After that, the sheet S is fed again to the transfer position, through the feeding section 23.

Further, it is also possible to dispose a post processing apparatus, which applies fold processing, staple processing, etc., to the sheets S, on the downstream side of the pair of ejection rollers 25.

Figure 2:
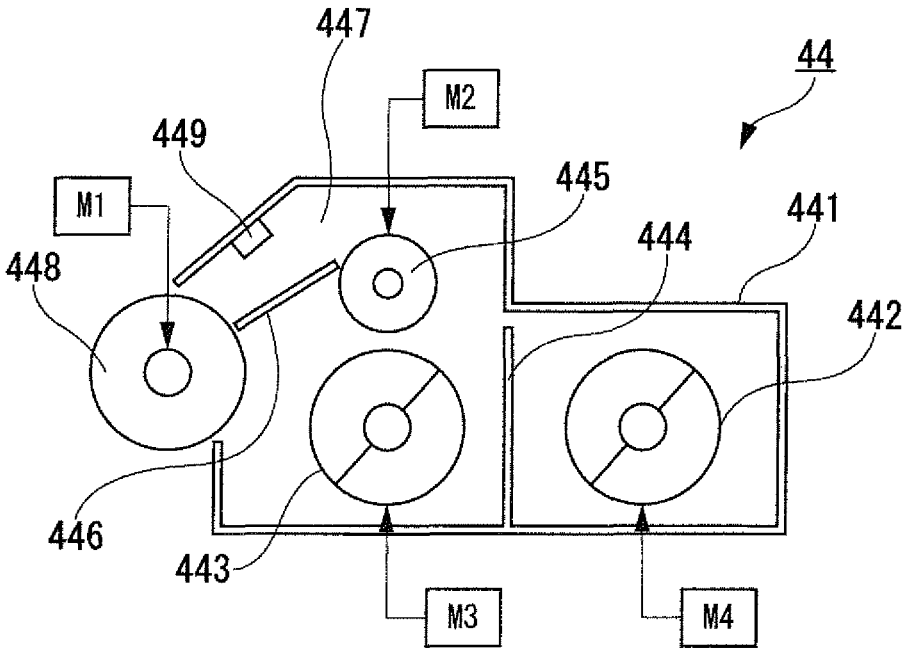
FIG. 2 is a diagram showing constitution of a developing unit in accordance with an embodiment of the present invention.

FIG. 2 shows constitution of each developing unit 44 shown in FIG. 1. The developing unit 44 is provided with screws 442 and 443, each serving as an agitating member, a partition plate 444, a supplying roller 445, a blade 446, a developer reservoir 447, a developing roller 448, and a detector 449, which are accommodated in a housing 441. The developing roller 448, the supplying roller 445, the screws 442 and 443 are driven to rotate by driving motors M1, M2, M3 and M4, respectively. The developer reservoir 447 is such a space that is formed by partitioning the inner space of the developing unit 44 with the supplying roller 445 and the blade 446 so as to be separated from another space in which the screws 442 and 443 and the partition plate 444 are arranged. Further, the developer reservoir 447 is disposed between the supplying roller 445 and the developing roller 448.

New developer is replenished into the developing unit 44 from a hopper (not shown) disposed within the image forming apparatus 1, through an opening (not shown) formed in a part of the housing 441, located above the screw 442. The developer replenished into the developing unit 44 is agitated by the screws 442 and 443, which are arranged side by side in a horizontal direction with the partition plate 444 placed between them, and thereby the replenished developer is charged by friction.

The supplying roller 445 includes a magnet, and is disposed above the screw 443. The charged developer scooped up by the screw 443 is attracted to the supplying roller 445 that rotates counterclockwise to be born thereon, by the magnetic force of the magnet included in the supplying roller 445, and is fed towards the developer reservoir 447 by rotation of the supplying roller 445. The developer fed by the supplying roller 445 towards the developer reservoir 447 is peeled off the supplying roller 445 by the blade 446, and is stored in the developer reservoir 447.

The developing roller 448 includes a magnet, and is disposed at the back of the developer reservoir 447, when seen from the supplying roller 445. A part of the developing roller 448 on the opposite side of a part thereof facing the developer reservoir 447 is exposed outside of the housing 441, and faces the corresponding photoreceptor 41 in FIG. 1. The developer stored in the developer reservoir 447 is carried by the developing roller 448 that rotates counterclockwise, and is caused to adhere onto an electrostatic latent image on the photoreceptor 41 with rotation of the developing roller 448. Thereby, the electrostatic latent image on the photoreceptor 41 is developed as a toner image.

The detector 449 is an optical sensor to detect the amount of developer in the developer reservoir 447 by measuring a surface position of the developer stored in the developer reservoir 447.

Figure 3:
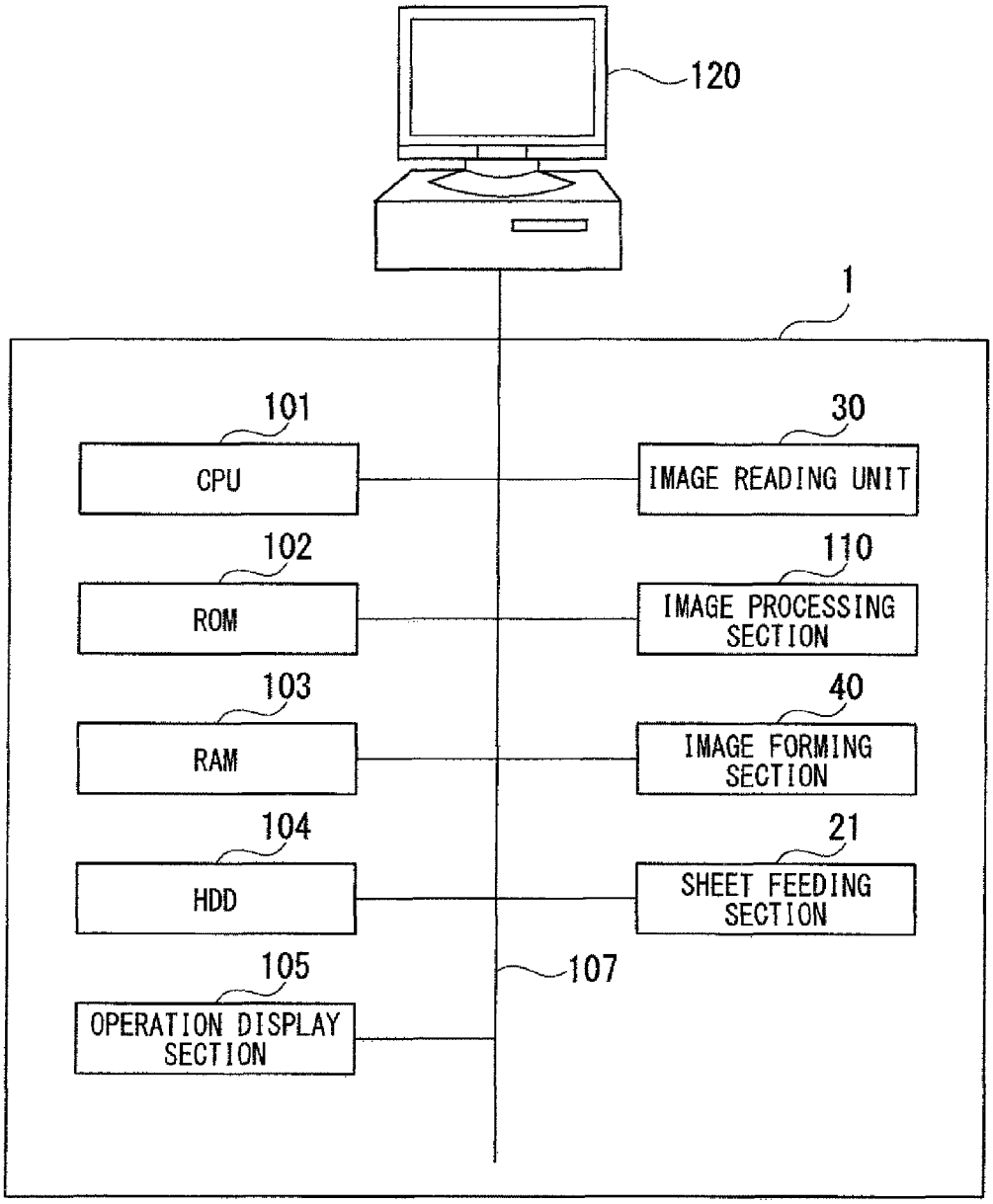
FIG. 3 is a block diagram showing constitution of a control system of an image forming apparatus in accordance with an embodiment of the present invention.

FIG. 3 shows constitution of a control system of the image forming apparatus 1. For instance, the image forming apparatus 1 includes: a CPU (Central Processing Unit) 101; a ROM (Read Only Memory) 102 to store programs to be executed by the CPU 101, etc.; and a RAM (Random Access Memory) 103 used as a working area of the CPU 101. In addition, the image forming apparatus 1 includes an HDD (Hard Disc Drive) 104 as a large-capacity storage device, and an operation display section 105. Note that, normally, an electrically erasable programmable ROM is employed as the ROM 102.

The CPU 101, which is an example of a control section, is connected to the ROM 102, the RAM 103, the HDD 104, and the operation display section 105, through a system bus 107, and controls the entire apparatus. Further, the CPU 101 is also connected to the image reading unit 30, an image processing section 110, the image forming section 40, and the sheet feeding section 21, through the system bus 107.

The HDD 104 stores image data of an image of an original-document, acquired by reading the image of the original-document with the image reading unit 30, and also stores already output image data, and so on. The operation display section 105 is a display touch panel configured by a display, such as an LCD (Liquid Crystal Display), an organic ELD (Electro Luminescence Display), etc. The operation display section 105 displays instruction menus for the user, information regarding acquired image data, etc. Further, the operation display section 105 is provided with a plurality of keys, and accepts inputting of various instructions, and data, such as characters, numerals, etc., through the key operations by the user, and outputs input signals.

The image reading unit 30 optically reads an image of an original-document, and generates image data thereof. For instance, in a case of reading an image of a color original-document, the image reading unit 30 generates image data including 10 bits luminance information per one pixel for each of R (Red), G (Green), B (Blue). Image data generated by the image reading unit 30 or transmitted from a PC (Personal Computer) 120 as an example of an external device connected to the image forming apparatus 1 is transmitted to the image processing section 110, and is subjected to image processing. The image processing section 110 applies various kinds of processing, such as analogue processing, analogue-to-digital conversion, shading correction, image compression, etc., to the received image data.

Note that in the present embodiment, an example in which a personal computer is employed as the external device has been described, but the scope of the external device is not limited to the personal computer. Various other kinds of apparatuses, for instance, a facsimile device or the like can be employed as the external device.

In a case where color image formation is performed in the image forming apparatus 1, RGB image data, generated by the image reading unit 30, etc., are input into a color conversion LUT (Look Up Table) in the image processing section 110, and are color-converted into image data of Y, M, C, and Bk. Successively, the image processing section 110 further applies correcting gradation reproduction characteristics, screen processing halftone dots by referring to a density correction LUT, edge processing for emphasizing fine lines, etc., to the color-converted image data.

The image forming section 40 receives image data image-processed by the image processing section 110, and based on the received image data, forms an image on the sheet S.

The information representing a detection result of the amount of developer within the developer reservoir 447 of the developing unit 44 by the detector 449 shown in FIG. 2 is transmitted to the CPU 101 from the image forming section 40.

At transmission of image data from the image reading section 30 or the PC 120 serving as the external apparatus, as the information for calculating the printing ratio of an image to be formed on a transfer material according to the image data, information representing the size of a sheet to be used in image formation of the image data and the area of an image portion in the sheet is transmitted to the CPU 101. Based on this information, the CPU 101 calculates the printing ratio of the image to be formed according to the image data.

Figure 4:
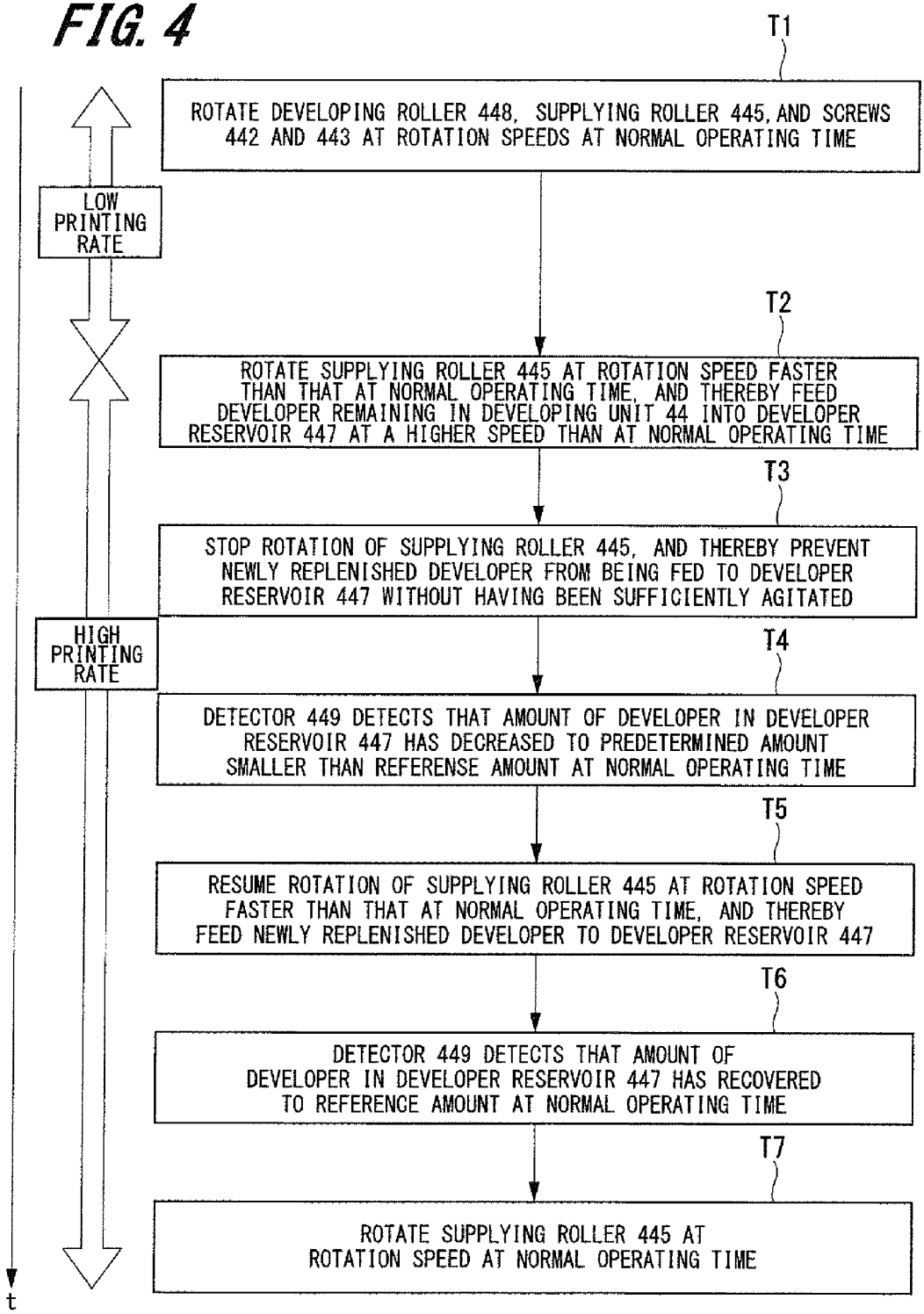
FIG. 4 is a diagram showing control contents of a developing unit, when a printing ratio of an image to be formed changes from a low printing ratio to a high printing ratio, in an image forming apparatus in accordance with an embodiment of the present invention.

FIG. 4 is a diagram showing contents of processing to control the developing unit 44 with time by the CPU 101, when the calculated printing ratio changes from a low printing ratio (for instance, equal to or lower than 10%) to a high printing ratio (for instance, equal to or higher than 30%). Passage of time "t" is indicated in the direction from the upper side of the diagram to the lower side thereof. When the calculated printing ratio indicates a low printing ratio, for instance, equal to or lower than 10% and consequently the consumption of developer (toner) is relatively small, the CPU 101 controls the driving motors M1, M2, M3 and M4 shown in FIG. 2 to rotate the developing roller 448, the supplying roller 445, and the screws 442 and 443 at rotation speeds at the normal operating time, respectively (T1 in FIG. 4).

After that, when the calculated printing ratio changes from the low printing ratio to a high printing ratio and consequently the consumption of developer increases, the CPU 101, while leaving the developing roller 448 and the screws 442 and 443 to rotate at the rotation speeds at the normal operating time, respectively, controls the driving motor M2 so as to rotate the supplying roller 445 at a rotation speed faster than that at the normal operating time (for instance, 1.2 times the rotation speed at the normal operating time), thereby feeding the developer sufficiently agitated by the screws 442 and 443 so as to be charged and remaining in the developing unit 44 into the developer reservoir 447 at a higher speed than at the normal operating time (T2 in FIG. 4).

Then, when the detector 449 detects that the amount of the developer stored in the developer reservoir 447 has reached a predetermined amount larger than a reference amount at the normal operating time, the CPU 101, while leaving the developing roller 448 and the screws 442 and 443 to rotate at the rotation speeds at the normal operating time, respectively, controls the driving motor M2 to stop rotation of the supplying roller 445. As a result, not only the predetermined amount of the sufficiently charged developer larger than the reference amount at the normal operating time is stored in the developer reservoir 447 in a shorter period of time than at the normal operating time, but also it is prevented that a relatively large amount of the developer newly replenished to the developing unit 44 from the hopper is fed to the developer reservoir 447 by the supplying roller 445 without having been sufficiently charged by being agitated by the screws 442 and 443 (T3 in FIG. 4).

In other words, while it is prevented that a relatively large amount of the developer newly replenished into the developing unit 44 and not sufficiently charged yet is supplied onto the developing roller 448, only the sufficiently charged developer residing within the developing unit 44 can be supplied to the developing roller 448, so as to be caused to adhere onto the latent image on the photoreceptor 41.

On the other hand, since the screws 442 and 443 continue to rotate to agitate the developer in the developing unit 44, it is possible to sufficiently charge the developer newly replenished into the developing unit 44. Also, the developer remaining within the developing unit 44 and the newly replenished developer can be sufficiently mingled together, and thereby the newly replenished developer is prevented from scattering within the developing unit 44.

Here, the reference amount of the developer in the developer reservoir 447 at the normal operating time is defined as an amount of developer in the developer reservoir 447 when an amount of developer entering into the developer reservoir 447 and an amount of developer getting out from the developer reservoir 447 are held in equilibrium with all of the developing roller 448, the supplying roller 445, and the screws 442 and 443 being rotated at the rotation speeds at the normal operating time, respectively.

Then, when the detector 449 detects that the amount of the developer in the developer reservoir 447 has decreased to a predetermined amount smaller than the reference amount at the normal operating time (T4 in FIG. 4), the CPU 101 controls the driving motor M2 to resume rotation of the supplying roller 445 at a rotation speed faster than that at the normal operation time (for instance, 1.1 times the rotation speed at the normal operation time), to feed the newly replenished developer, sufficiently mingled and charged, to the developer reservoir 447 (T5 in FIG. 4).

Thus, since the CPU 101 controls the driving motor M2 to resume rotation of the supplying roller 445 when the detector 449 detects that the amount of the developer in the developer reservoir 447 has decreased, not to the reference amount of developer at the normal operating time, but to an amount smaller than the reference amount of developer at the normal operating time, it becomes possible to secure the time for sufficiently charging the newly replenished developer in the developing unit 44.

After that, when the detector 449 detects that the amount of the developer in the developer reservoir 447 has recovered to the reference amount at the normal operating time (T6 in FIG. 4), the CPU 101 controls the driving motor M2 to rotate the supplying roller 445 at the rotation speed at the normal operating time (T7 in FIG. 4). Thereby, as in the state before the printing ratio has changed to the high printing ratio, all of the developing roller 448, the supplying roller 445, and the screws 442 and 443 resume rotation at the rotation speeds at the normal operating time, respectively.

As described above, according to the image forming apparatus in accordance with this embodiment, by controlling, with the CPU 101, driving of the supplying roller 445 of the developing unit 44 independently from driving of the developing roller 448 and the screws 442 and 443, it is possible to supply only the sufficiently charged developer to the developing roller 448, and thereby it becomes possible to suppress the fogging phenomenon.

That is, for instance, in a case where the printing ratio of an image to be formed according to image data has changed from a low printing ratio to a high printing ratio, the CPU 101 controls driving of the supplying roller 445 so as to store sufficiently charged developer remaining in the developing unit 44 into the developer reservoir 447 within a shorter period of time than at the normal operating time and not to feed newly replenished developer to the developer reservoir 447 without having been sufficiently agitated by the screws 442 and 443. Thereby, it becomes possible to supply only the sufficiently charged developer remaining in the developing unit 44 to the developing roller 448, while preventing the newly replenished developer from being supplied to the developing roller 448 from the screws 442 and 443, so as to cause only the sufficiently charged developer to adhere onto the latent image on the photoreceptor 41.

Further, by controlling driving of the screws 442 and 443 so as to continue agitating, it is possible to sufficiently charge the developer newly replenished into the developing unit 44. Furthermore, by sufficiently mingling the developer remaining in the developing unit 44 and the newly replenished developer together, it is possible to prevent the newly replenished developer from scattering within the developing unit 44.

An embodiment of the present invention has been described in the foregoing. However, the scope of the present invention is not limited to the aforementioned embodiment, and it is possible to implement various kinds of modifications without departing from the gist of the invention described in the claims.

For instance, in the above-mentioned embodiment, although an example for forming a color image by providing the four image forming units 40Y, 40M, 40C, 40K in the image forming section 40 has been described, the present invention may be also applicable to an image forming apparatus that is provided with a single image forming unit to form a unicolor image.

Further, although an example has been described, in which the intermediate transfer belt 50 serving as the transfer material onto which a toner image formed on the photoreceptor 41 is transferred is provided and the toner image is secondarily transferred onto the sheet S from the intermediate transfer belt 50, the present invention may be also applicable to such an image forming apparatus in which a toner image formed on a photoreceptor is directly transferred onto a sheet from the photoreceptor.

Still further, in the aforementioned embodiment, an example has been described, in which the detector 449 detects that the amount of the developer in the developer reservoir 447 of the developing unit 44 has decreased to the predetermined amount smaller than the reference amount at the normal operating time, for example in the process of T4 in FIG. 4. However, the scope of the present invention is not limited to such example. It is also possible that the CPU 101 calculates the amount of developer in the developer reservoir 447 based on the elapsed time and the number of sheets to which the image forming operation has been applied after the rotation of the supplying roller 445 has been stopped at T3 in FIG. 4, and based on the calculated result, determines that the amount of developer in the developer reservoir 447 of the developing unit 44 has decreased to the predetermined amount smaller than the reference amount at the normal operating time.

Still further, in the aforementioned embodiment, an example has been described in which after rotation of the supplying roller 445 has been stopped, when the detector 449 detects that the amount of the developer in the developer reservoir 447 has decreased to an amount smaller than the reference amount of developer at the normal operating time, the rotation of the supplying roller 445 is resumed at a rotation speed faster than that at the normal operating time (T4 and T5, shown in FIG. 4). However, the scope of the present invention is not limited to such example. After the rotation of the supplying roller 445 has been stopped, when the detector 449 detects that the amount of the developer in the developer reservoir 447 has decreased to the reference amount at the normal operating time, the rotation of the supplying roller 445 may be resumed at the rotation speed at the normal operating time.

Yet further, in the aforementioned embodiment, an example has been described, in which the CPU 101 calculates the printing ratio of an image to be formed on a transfer material according to image data, and in a case where the printing ratio has changed from a low printing ratio to a high printing ratio, the CPU 101 controls driving of the supplying roller 445 of the developing unit 44 independently from driving of the developing roller 448, and the screws 442 and 443. However, the scope of the present invention is not limited to such example. As the information other than the printing ratio of an image to be formed, the CPU 101 may calculate or acquire information on the consumption amount of developer in forming an image to be formed, and then, in a case where the consumption amount of developer has changed from a value lower than a predetermined amount to another value higher than the predetermined amount, the CPU 101 may control driving of the supplying roller 445 independently from driving of the developing roller 448, and the screws 442 and 443.

According to the image forming apparatus configured as aforementioned, since a control section controls driving of a supplying roller to supply charged developer to a developing roller independently from driving of an agitating member to agitate replenished developer so as to be charged, it becomes possible to supply only sufficiently charged developer to the developing roller, and thereby occurrence of the fogging phenomenon is suppressed.

It should be understood by those skilled in the art that various modifications, combinations, sub-combinations and alterations may be possible depending on design requirements and other factors within the scope of the appended claims or the equivalents thereof.

What is claimed is:

1. An image forming apparatus, comprising:

a developing unit configured to develop a latent image formed on a photoreceptor according to image data, with developer, the developing unit comprising:

an agitating member configured to agitate the developer replenished into the developing unit, so as to be electrically charged;

a supplying roller configured to bear thereon the developer charged by being agitated by the agitating member and to be driven to rotate to feed the charged developer borne thereon;

a developer reservoir configured to store therein the charged developer fed by the supplying roller;

a developing roller configured to bear thereon the charged developer stored in the developer reservoir and to cause the charged developer born thereon to adhere onto the latent image on the photoreceptor to develop the latent image with the developer, wherein the developer reservoir is disposed between the supplying roller and the developing roller, and the supplying roller feeds the developer charged by being a its by the agitating member into the developer reservoir: and a control section configured to control driving of the supplying roller independently from driving of the agitating member, wherein the control section is configures to perform controlling driving of the supplying roller independently from driving of the agitating member on the basis of information on an amount of the developer to be used in developing the latent image formed on the photoreceptor according to image data, and the amount of the developer to be used in developing the latent image formed on the photoreceptor according to image data is calculated based on the image data according to which the latent image has been formed on the photoreceptor, wherein when the calculated amount of the developer to be used has changed from an amount lower than a predetermined amount to an amount higher than the predetermined amount, the control section is configured to perform controlling driving of the supplying roller so as to rotate the supplying roller at a rotation speed faster than a reference rotation speed, and thereafter stop rotation of the supplying roller, wherein the control section is configured to perform controlling driving of the supplying roller, after stopping the rotation of the supplying roller, so as to resume rotation of the supplying roller according to an amount of the developer in the developer reservoir wherein the control section is configured to perform controlling driving of the supplying roller, after stopping the rotation of the supplying roller, so as to resume the rotation of the supplying roller at a rotation speed faster than the reference rotation speed when the amount of the developer in the developer reservoir has become smaller than a reference amount.

2. The image forming apparatus of claim 1, wherein the control section is configured to perform controlling driving of the supplying roller, after resuming rotation of the supplying roller, so as to rotate the supplying roller at the reference rotation speed when the amount of the developer in the developer reservoir has recovered to the reference amount.

3. The image forming apparatus of claim 1, further comprising:

a detector configured to detect an amount of the developer in the developer reservoir, wherein the amount of the developer in the developer reservoir, according to which the control section performs controlling driving of the supplying roller so as to resume rotation of the supplying roller, is detected by the detector.

* * * * *